United States Patent [19]

Meyer et al.

[11] 3,984,929

[45] Oct. 12, 1976

[54] DETACHABLE CUTTING EDGE AND TIP-ADAPTER ARRANGEMENT FOR LOADER BUCKETS

[75] Inventors: David L. Meyer, Peotone; Visvaldis A. Stepe, Willow Springs, both of Ill.

[73] Assignee: Caterpillar Tractor Co., Peoria, Ill.

[22] Filed: Oct. 8, 1975

[21] Appl. No.: 620,737

[52] U.S. Cl. ..... 37/141 R; 172/719; 172/702

[51] Int. Cl.[2] ..... E02F 9/28

[58] Field of Search ..... 37/141 R, 141 T, 142 R, 37/142 A; 172/719, 770, 702, 713, 766

[56] References Cited

UNITED STATES PATENTS

| | | | |
|---|---|---|---|
| 3,465,833 | 9/1969 | Lutz | 172/719 |
| 3,469,331 | 9/1969 | Wood | 172/719 X |
| 3,497,973 | 3/1970 | Campbell | 172/719 X |
| 3,621,594 | 11/1971 | Hahn et al. | 37/141 R |
| 3,762,079 | 10/1973 | Lukavich et al. | 37/141 R |
| 3,841,007 | 10/1974 | Howarth et al. | 37/141 R |
| 3,851,413 | 12/1974 | Lukavich | 37/141 T |
| 3,888,027 | 6/1975 | Toews | 172/719 X |

FOREIGN PATENTS OR APPLICATIONS

| | | | |
|---|---|---|---|
| 80,687 | 6/1934 | Sweden | 172/766 |
| 283,914 | 1/1971 | U.S.S.R. | 172/719 |

*Primary Examiner*—E. H. Eickholt
*Attorney, Agent, or Firm*—Phillips, Moore, Weissenberger, Lempio & Strabala

[57] ABSTRACT

A loader bucket comprises a bottom wall having an elongated general purpose edge disposed forwardly thereon. A cutting edge is bolted onto an underside of the general purpose edge along with a plurality of laterally spaced adapters. A plurality of U-shaped notches are formed on a forward edge of the cutting edge and each notch receives a like-shaped lower portion of an adapter therein. Each adapter has a hardened earthworking tip detachably mounted thereon by a pin. In a first embodiment of this invention, the cutting edge is reversible and has a plurality of such notches formed on both the forward and rearward edges thereof whereas in a second embodiment of this invention such notches are solely formed on the forward edge of the cutting edge.

13 Claims, 6 Drawing Figures

DETACHABLE CUTTING EDGE AND TIP-ADAPTER ARRANGEMENT FOR LOADER BUCKETS

BACKGROUND OF THE INVENTION

This invention relates to a work implement, such as a loader bucket, having a cutting edge and a plurality of adapters and tips detachably mounted thereon. A conventional loader bucket normally comprises a cutting edge secured forwardly on a bottom wall thereof for performing various clean-up operations. In certain work applications, it is desirable to attach a plurality of hardened tips on the bucket particularly for digging and like earthworking operations. The substantial loads imposed on the tips make it imperative that the adapter be firmly secured to the bucket to prevent dislodgement thereof. It is further desirable to flush-mount the cutting edge, adapters and tips on the bucket to prevent loose cutting materials from slipping thereunder.

SUMMARY OF THIS INVENTION

An object of this invention is to provide an improved and highly versatile cutting edge and tip-adapter arrangement for a work implement, such as a loader bucket. The work implement comprises an elongated and flat general purpose edge disposed forwardly thereon and a flat cutting edge mounted beneath the general purpose edge to be substantially coextensive therewith laterally. A forward edge of the cutting edge has a plurality of laterally spaced notches formed thereon.

A lower portion of an adapter extends rearwardly under the general purpose edge and into a respective one of the notches and an upper portion thereof extends rearwardly over such edge. Fastening means releasably secure the cutting edge and adapters on the general purpose edge and a hardened earthworking tip is mounted on each one of the adapters. The versatility of such arrangement stems from the fact that the work implement can be utilized sans the cutting edge to increase the "aggressiveness" thereof or sans the tip-adapters for clean-up operations and the like.

In a first embodiment of this invention, the cutting edge is reversible with a plurality of such notches being formed on both the forward and rearward edges thereof whereas in a second embodiment such notches are formed on the forward edge only. The cutting edge for each such embodiment may constitute a pair of aligned and interchangeable segments whereby corner wear can be compensated for.

BRIEF DESCRIPTION OF THE DRAWINGS

Further objects of this invention will become apparent from the following description and accompanying drawings wherein.

DETAILED DESCRIPTION

Figure 1:
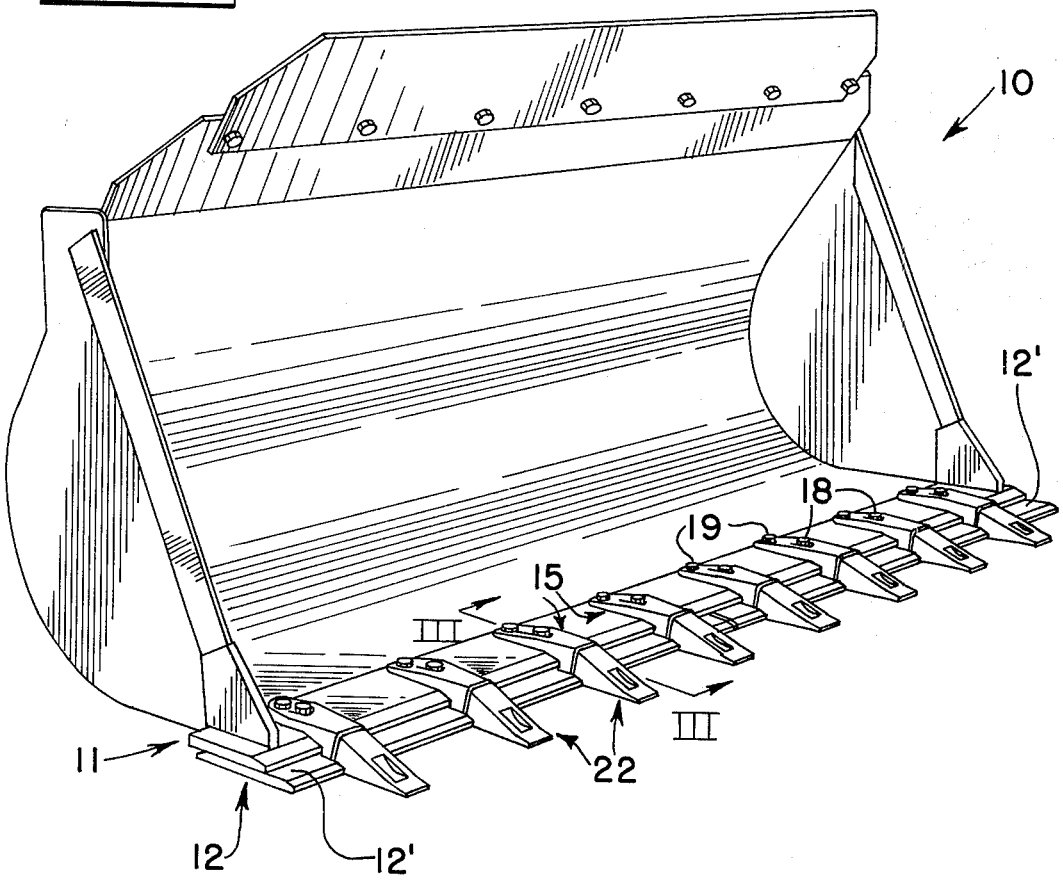
FIG. 1 is a front isometric view of a loader bucket employing the detachable cutting edge and tip-adapter arrangement of this invention thereon.
Figure 2:
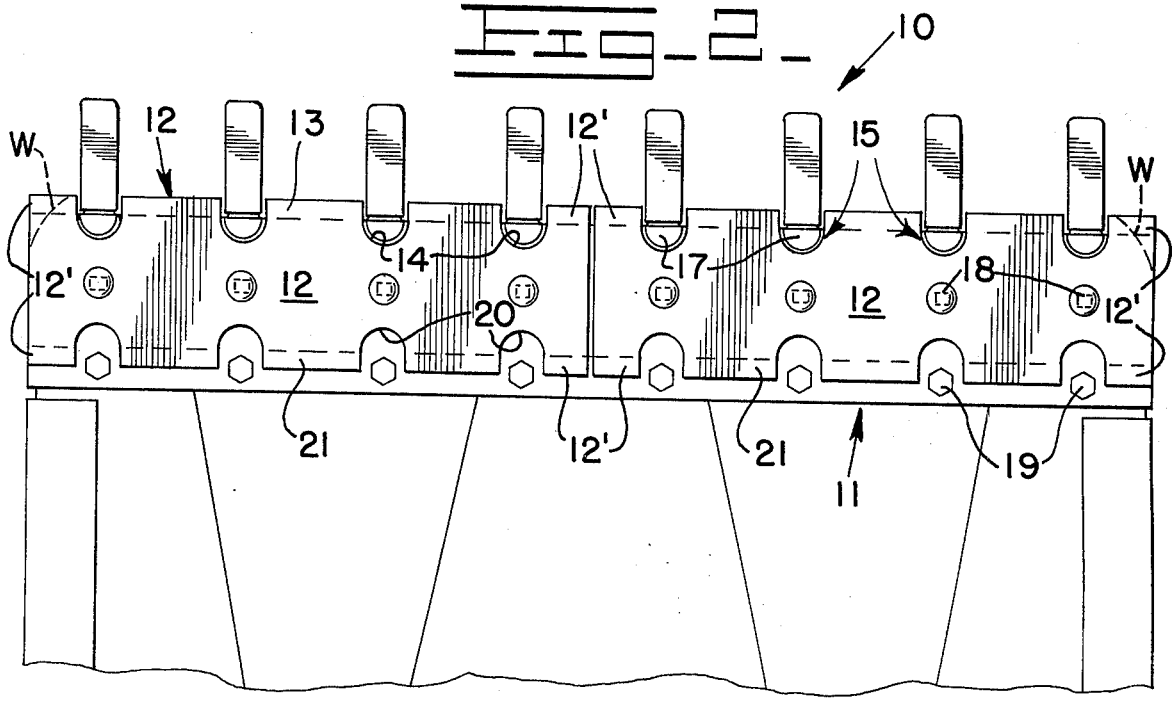
FIG. 2 is a plan view of the cutting edge and tip-adapter arrangement, viewed from the underside of the bucket.

FIGS. 1 and 2 illustrate a loader bucket 10 having an elongated and flat general purpose edge disposed forwardly thereon and secured to the bottom wall of the bucket. A flat cutting edge 12 is mounted beneath edge 11 to be substantially coextensive therewith and to terminate at wear corners 12′, disposed outboard of the bucket. The cutting edge has a forward edge 13 projecting forwardly therefrom and a plurality of first U-shaped and laterally spaced notches 14 formed therethrough.

Figure 3:
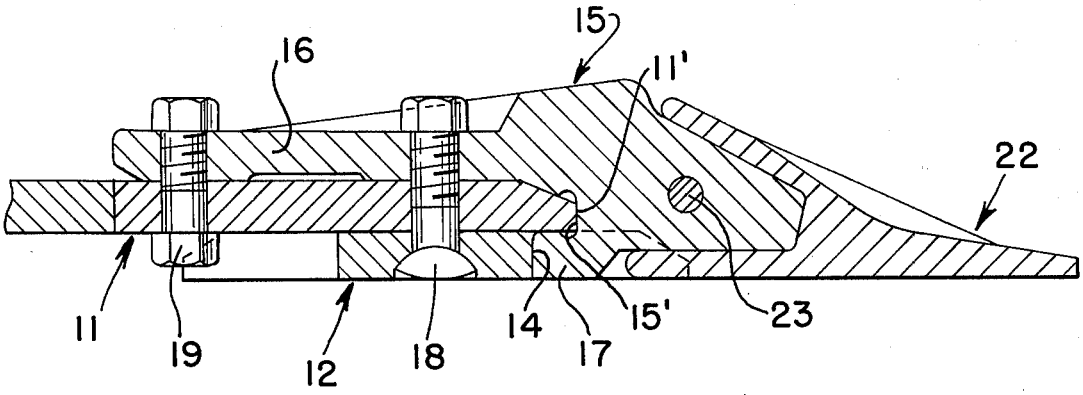
FIG. 3 is an enlarged sectional view, taken in the direction of arrows III—III in FIG. 1.

A plurality of laterally spaced adapters 15 are each mounted in straddling relationship on general purpose edge 11, as more clearly shown in FIG. 3. In particular, each adapter comprises an upper portion 16 extending rearwardly substantially over the full width of edge 11 and a lower portion 17 extending rearwardly under a limited forward portion of such edge. Portions 16 and 17 of the adapter thus cooperate to prevent the adapter from moving vertically relative to edge 11.

Figure 4:
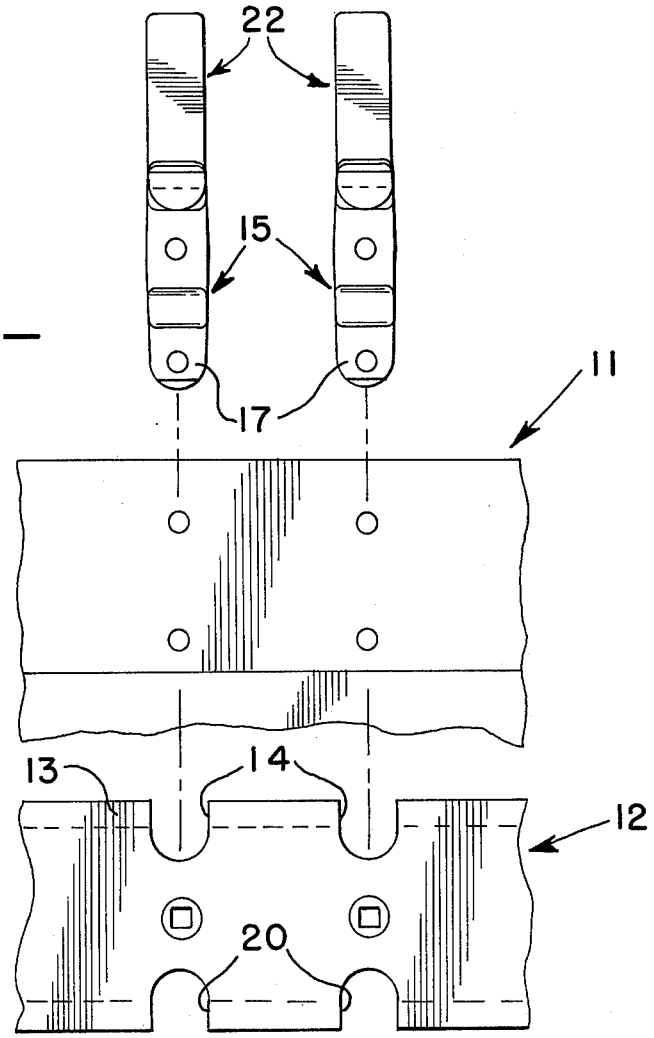
FIG. 4 is an enlarged exploded view of a portion of the cutting edge and tip-adapter arrangement, as viewed in FIG. 2.

Referring to FIGS. 2 and 4, the rearward end of lower portion 17 of the adapter is U-shaped to accommodate its disposition within a respective like-shaped notch 14. Fastening means for releasably securing the cutting edge and each adapter to edge 11 may comprise a pair of spaced bolts 18 and 19 each having a nut secured to an upper threaded end thereof (FIG. 3). It should be noted that bolt 18 extends upwardly sequentially through cutting edge 12, general purpose edge 11 and upper portion 16 of adapter 15 whereas bolt 19 only extends through the general purpose edge and the upper portion of the adapter. It should be noted in FIG. 3 that a forward surface 11′ of edge 11 abuts an internal bearing surface 15′ of adapter 15 to prevent digging loads from being imposed on the bolts.

Referring once again to FIGS. 2 and 4, the cutting edge is symmetrical and reversible in that a plurality of second U-shaped notches 20 are formed through a rearward edge 21 of the cutting edge and in alignment with the first notches. The cutting edge may be formed in two or more laterally aligned and interchangeable segments, if so desired, as shown in FIG. 1. Each of the rectangular segments may thus have four identical wear corners 12′ formed thereon to compensate for the corner wear indicated at W in FIG. 2. It should be noted in FIG. 3 that the heads of bolts 19 are each disposed in a respective notch 20 and the heads of bolts 18 are countersunk in the cutting edge.

A substantially flush and co-planar relationship is thus maintained across adjacent bottom surfaces of the cutting edge, lower portion 17 of the adapter and a hardened earth-working tooth or tip 22. Cutting edge 12 and the lower portion of the adapter have substantially equal identical thicknesses to aid in providing such a flush relationship. The above-described relationship induces a smooth flow of material into the bucket, deters loose cutting materials from slipping thereunder to cause excessive tire wear, and aids in grading and finishing work, for example. Tip 22 is mounted on a forward end of an adapter and is attached thereon by a pin 23 which may be held in place in a conventional manner.

Figure 5:
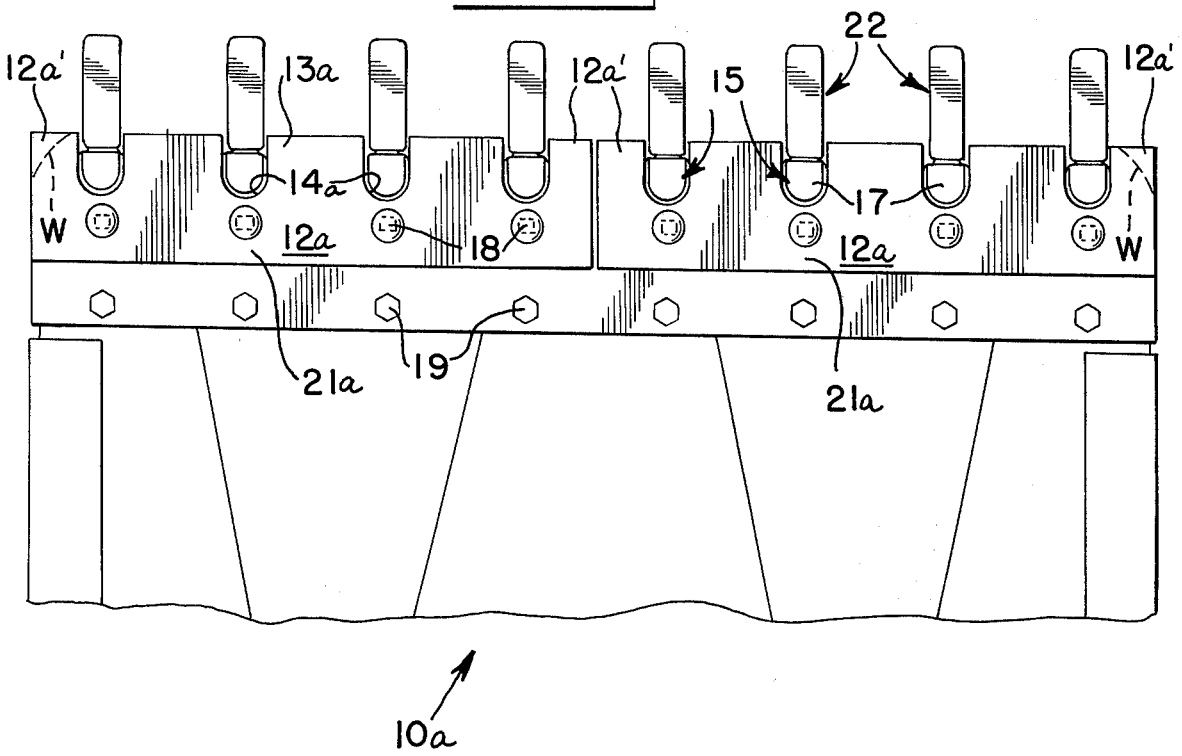
FIG. 5 is a bottom plan view similar to FIG. 2, but illustrating a loader bucket employing a modified cutting edge thereon.
Figure 6:
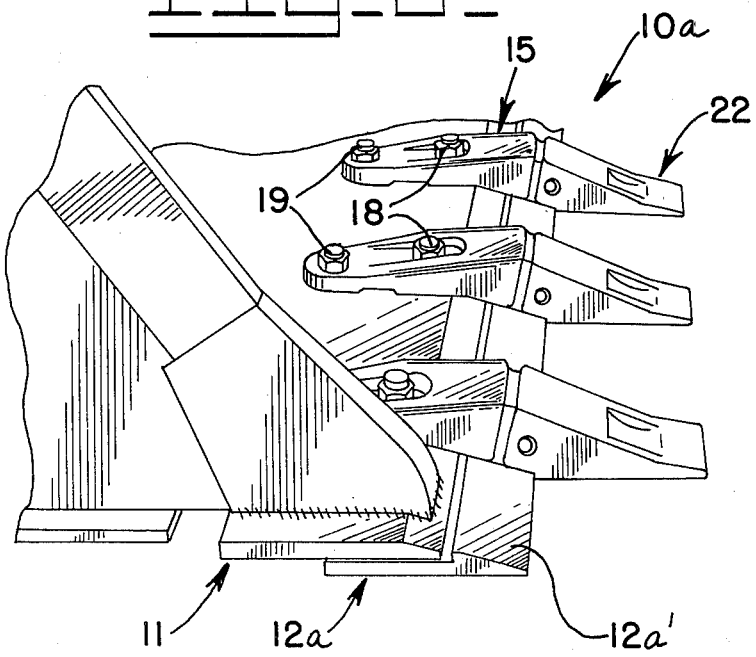
FIG. 6 is a partial isometric view of the FIG. 5 loader bucket.

FIGS. 5 and 6 partially illustrate a loader bucket 10*a* having a modified cutting edge 12*a* secured thereon. Corresponding structures are depicted by identical numerals with numerals depicting modified constructions being accompanied by an *a*.

Cutting edge 12*a* comprises a half-arrow construction and is secured onto an underside of general purpose edge 11. As shown in FIG. 5, a forward edge 13*a* of the cutting edge has a plurality of U-shaped notches 14*a* formed therein and spaced laterally therealong to each receive a lower portion 17 of a respective adapter 15. The adapters are secured to edge 11 along with the cutting edge in the manner described above by bolts 18 and 19. A rearward edge 21*a* of each of the cutting edge segments is straight and uninterrupted. The cutting edge may be formed as two interchangeable segments each having a pair of wear corners 12*a'* formed thereon to compensate for corner wear W.

It should be noted that in both of the above-described loader bucket embodiments that the adapters and tips can be removed from the bucket with the cutting edge reattached thereon for clean-up job tasks and the like. Alternatively, the cutting edge can be removed and only the adapters and tips attached to the bucket to increase the "aggressiveness" thereof for earthworking purposes.

We claim:

1. A work implement comprising an elongated and flat general purpose edge disposed forwardly thereon, a flat cutting edge mounted beneath said general purpose edge to be substantially co-extensive therewith and having a forward edge, a plurality of laterally spaced first notches formed on the forward edge of said cutting edge, a plurality of laterally spaced adapters each having an upper portion extending rearwardly over said general purpose edge and a lower portion extending rearwardly under said general purpose edge and disposed in a respective one of said notches, fastening means releasably securing ssid cutting edge and said adapters on said general purpose edge, and a hardened earthworking tip mounted on a forward end of each one of said adapters.

2. The work implement of claim 1 wherein said work implement constitutes a loader bucket.

3. The work implement of claim 2 wherein each lateral end of said cutting edge terminates at a wear corner disposed outboard of said loader bucket.

4. The work implement of claim 1 wherein each of said notches and a respective lower portion of a said adapter are U-shaped.

5. The work implement of claim 1 wherein adjacent bottom surfaces of said cutting edge, the lower portion of each one of said adapters and each one of said earthworking tips are at least substantially flush and co-planar relative to each other.

6. The work implement of claim 1 wherein said cutting edge constitutes a plurality of laterally aligned and rectangular segments.

7. The work implement of claim 6 wherein said cutting edge constitutes a pair of said segments each having a pair of identical wear corners formed forwardly thereon.

8. The work implement of claim 7 wherein each of said segments has a pair of identical wear corners formed rearwardly thereon.

9. The work implement of claim 1 wherein each of said fastening means comprises at least one first bolt extending upwardly sequentially through said cutting edge, said general purpose edge and the upper portion of a respective one of said adapters.

10. The work implement of claim 9 wherein a head of said bolt is substantially flush relative to a bottom surface of said cutting edge.

11. The work implement of claim 9 wherein each of said fastening means further comprises a second bolt extending upwardly sequentially through only said general purpose edge and the upper portion of a respective one of said adapters.

12. The work implement of claim 1 wherein a plurality of laterally spaced second notches are formed on a rearward edge of said cutting edge with each of said second notches being disposed in alignment with a respective one of said first notches whereby said cutting edge is adapted to be reversed on said general purpose edge.

13. The work implement of claim 1 wherein a rearward edge of said cutting edge is straight and uninterrupted.

* * * * *